US008672469B1

(12) United States Patent
Walker et al.

(10) Patent No.: US 8,672,469 B1
(45) Date of Patent: Mar. 18, 2014

(54) DRYERS THAT USE ROLLERS TO DEFINE FIRE ENCLOSURE OPENINGS

(71) Applicants: Casey E. Walker, Boulder, CO (US); Scott Johnson, Erie, CO (US); Stuart J. Boland, Denver, CO (US); William Edward Manchester, Erie, CO (US); David M Price, Loveland, CO (US)

(72) Inventors: Casey E. Walker, Boulder, CO (US); Scott Johnson, Erie, CO (US); Stuart J. Boland, Denver, CO (US); William Edward Manchester, Erie, CO (US); David M Price, Loveland, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/630,473

(22) Filed: Sep. 28, 2012

(51) Int. Cl.
*G03G 15/20* (2006.01)

(52) U.S. Cl.
USPC ..... 347/102; 399/335; 399/336

(58) Field of Classification Search
USPC ..... 347/101, 102, 104, 212; 399/320, 335, 399/336, 337
See application file for complete search history.

(56) References Cited

U.S. PATENT DOCUMENTS

| | | | | |
|---|---|---|---|---|
| 3,778,222 | A | 12/1973 | Suzuki | |
| 3,979,161 | A | 9/1976 | Kremer et al. | |
| 4,317,026 | A | 2/1982 | Koblo et al. | |
| 4,402,594 | A | 9/1983 | Pelda et al. | |
| 5,475,788 | A | 12/1995 | Classens et al. | |
| 6,125,759 | A | 10/2000 | Epps | |
| 7,085,510 | B2 | 8/2006 | Rosenstock | |
| 7,873,288 | B2 * | 1/2011 | Taubenberger et al. | 399/33 |
| 2004/0001733 | A1 | 1/2004 | Richtsmeier et al. | |
| 2010/0242767 | A1 | 9/2010 | Hauer | |

OTHER PUBLICATIONS

U.S. Appl. No. 13/486,520.

* cited by examiner

*Primary Examiner* — Huan Tran
(74) *Attorney, Agent, or Firm* — Duft, Bornsen & Fettig LLP

(57) ABSTRACT

Systems and methods are provided for drying print media. The system comprises a dryer comprising an enclosure and a roller. The roller is proximate to an opening into the enclosure. A perimeter of the roller covers a portion of the opening, and an uncovered portion of the opening comprises a gap for a web of print media. The gap has a size defined on one side by the perimeter of the roller and on another side by a surface of the opening.

20 Claims, 5 Drawing Sheets

DRYERS THAT USE ROLLERS TO DEFINE FIRE ENCLOSURE OPENINGS

FIELD OF THE INVENTION

The invention relates to the field of printing, and in particular, to dryers that dry marking material onto print media.

BACKGROUND

In continuous-forms printing systems, one or more marking engines are used to apply marking material (e.g., ink) onto a web of print media. The web is driven through the marking engines and into a dryer. As the web travels through the dryer, the dryer heats the web and dries the marking material onto the web. The web moves quickly across the printing system in order to enable fast printing speeds. For example, the web may travel at many linear feet per second through the printing system. This means that dryers must either occupy a large space within the print shop or use a great deal of heat to dry the web. For example, in many dryers, inked portions of the web transit the entire length of the dryer in a fraction of a second.

When dryers apply large amounts of heat to a web, there is a risk of a fire igniting along the web and escaping the dryer. To address this issue, dryers often use a tunnel that is bordered on all sides by solid walls. The web is heated as it travels through the tunnel, but the tunnel has narrow entrances which are so small that even if the paper is overheated, there is insufficient mass transfer of oxygen from the outside to enable the fire to leave the dryer via the tunnel.

FIG. 1 is a block diagram of a prior art dryer unit 110. Dryer unit 110 includes an array of heating lamps 114 which heat web 120 as it travels through tunnel 112. In FIG. 1, the radiant heat from radiant heating lamps 114 is indicated by element 116. Rollers 130 and 140 position web 120 as it enters and exits dryer unit 110, in order to tension web 120 during its transit through tunnel 112. Tunnel 112 includes openings 118, which are so narrow that any fires which start within dryer unit 110 do not have sufficient oxygen to escape along tunnel 112 and out of dryer unit 110. Openings 118 are known in the art as fire enclosure openings because they prevent fires from spreading outside of dryer unit 110.

Fire enclosure openings remain problematic in existing dryers. For example, even when tension is applied by rollers 130 and 140 to keep web 120 taut, web 120 may still experience upward and downward deflection along the scan direction as it travels through tunnel 112 (this is referred to as "flapping"). In addition, the web may exhibit wrinkling or puckering along the process direction due to excessive moisture from the applied marking material (this is referred to as "cockling"). This may cause further issues.

FIG. 2 is a block diagram illustrating limitations of a prior art drying unit. Here, only tunnel 112 of dryer unit 110 is illustrated. In FIG. 2, rollers 130 and 140 minimize deflection and deformation of web 120 at points 210 and 220, respectively. However, as web 120 travels through tunnel 112, it may deflect upward and/or downward by a small amount. Naturally, the amount of deflection depends on the distance to the nearest roller, physical properties of the web itself, travel speed of the web, and the amount of tension on the web. Because the narrow openings 118 are not very tall (e.g., only millimeters in height), web 120 may deflect into the ceiling of the fire enclosure openings formed by these openings 118 (e.g., at locations 230 and 240). This in turn smears marking material on web 120, which reduces print quality and is undesirable.

Thus, manufacturers continue to search for systems that improve the capabilities of dryers for printing systems.

SUMMARY

Embodiments described herein use a roller to define a border of a fire enclosure opening for a dryer. Using a roller in this way prevents flapping of a web of print media as it travels through the fire enclosure opening. When the web travels within the fire enclosure opening, the web is held to the roller and therefore unlikely to experience any substantial deflection or wrinkling. Because deflection of the web of media at the roller itself is almost zero when it is in contact with the roller, the web is least likely to have an inked portion rub against the fire enclosure opening.

One embodiment is a dryer. The dryer comprises an enclosure that includes an opening for a web of print media to travel between an exterior of the enclosure and an interior of the enclosure. The dryer further comprises a heating element that is operable supply heat to the interior, and a roller proximate to the opening that aligns the web as the web travels within the interior. A perimeter of the roller covers a portion of the opening, and an uncovered portion of the opening comprises a gap for the web. The gap has a size defined on one side by the perimeter of the roller and on another side by a surface of the opening.

Another embodiment is another dryer. The dryer comprises an enclosure and a roller. The roller is proximate to an opening into the enclosure, wherein a perimeter of the roller covers a portion of the opening, and wherein an uncovered portion of the opening comprises a gap for a web of print media. The gap has a size defined on one side by the perimeter of the roller and on another side by a surface of the opening.

Another embodiment is a printing system. The system comprises a continuous-forms printer, and a printing system dryer operable to dry a web of print media that has been marked by the printer. The dryer includes an enclosure and a heating element located within an interior of the enclosure that is operable to generate heat within the enclosure. The dryer further includes a first roller located proximate to the enclosure that obscures a portion of an opening into the enclosure and positions the web of print media as the web enters the enclosure, where the unobscured portion of the opening is sufficiently small to prevent fires inside of the enclosure from leaving the enclosure via the entrance. The dryer further includes a second roller located proximate to the enclosure that obscures a portion of another opening into the enclosure and positions the web as the web exits the enclosure, where the unobscured portion of the other opening is sufficiently small to prevent fires inside of the enclosure from leaving the enclosure via the exit.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
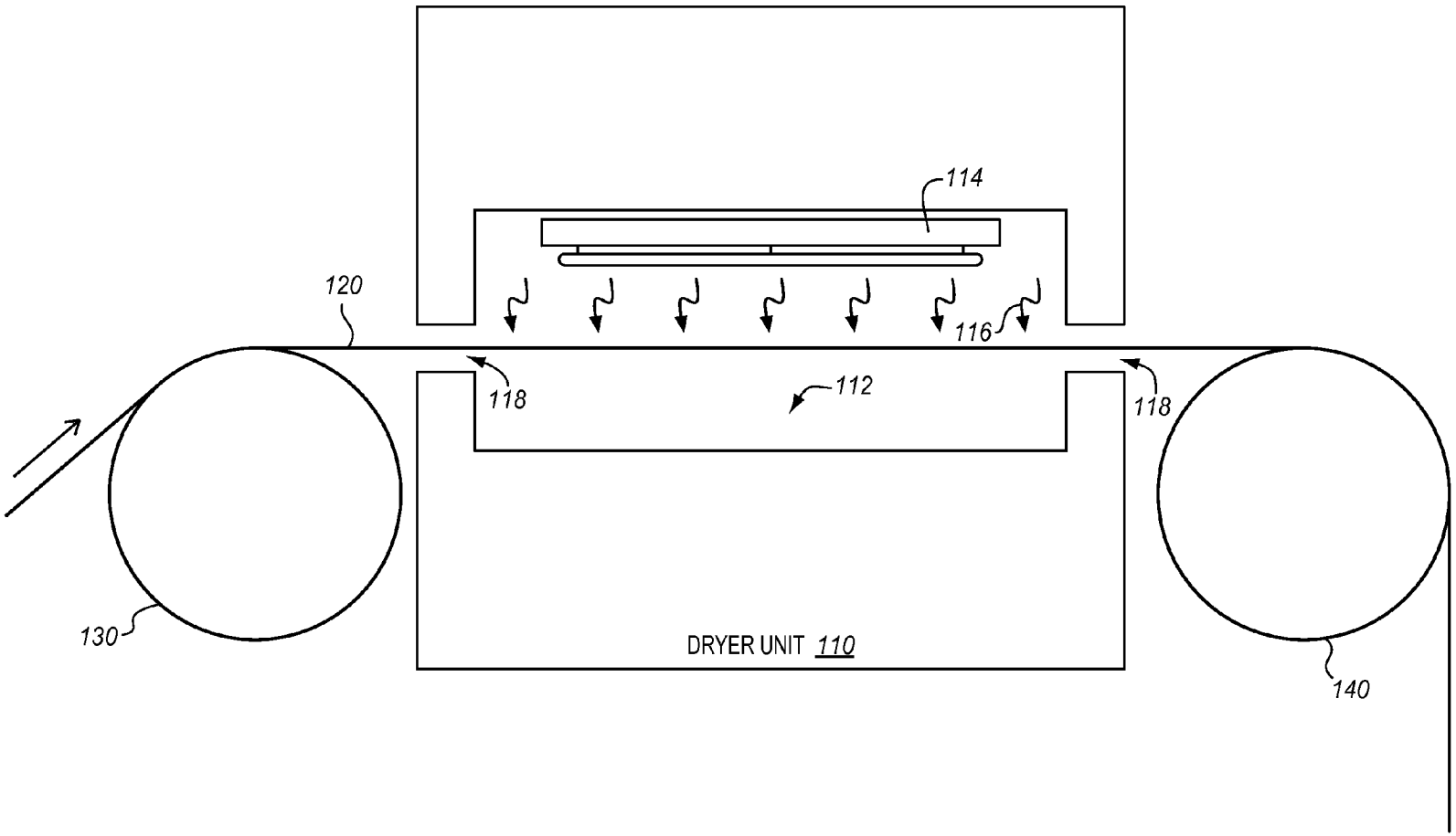
FIG. 1 PRIOR ART
FIG. 1 is a block diagram of a cut-away side view prior art drying unit.
Figure 2:
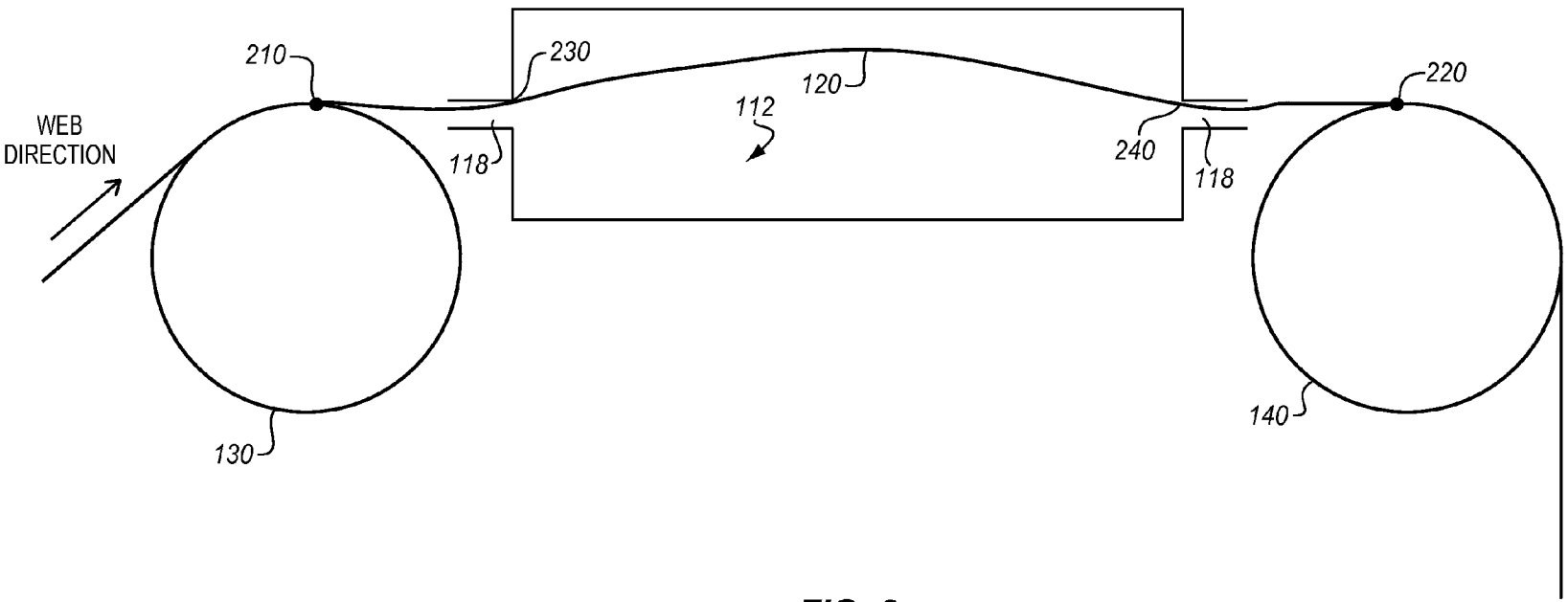
FIG. 2 is a block diagram illustrating limitations of a prior art drying unit.
Figure 3:
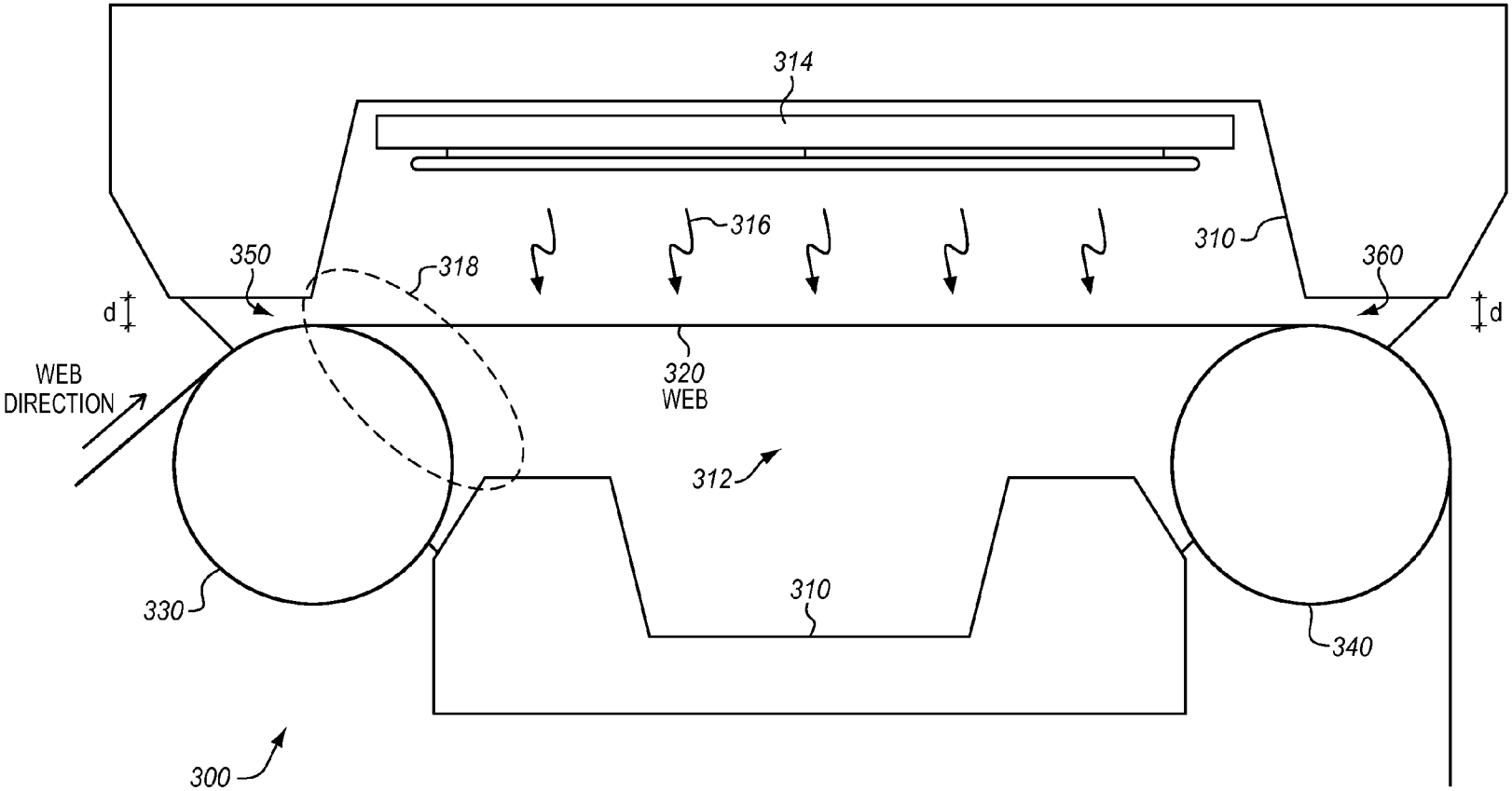
FIG. 3 is a block diagram illustrating a cut-away side view of a dryer unit in an exemplary embodiment.

FIG. 3 is a block diagram illustrating a cut-away side view of a dryer unit 300 in an exemplary embodiment. Dryer unit 300 is used to dry incoming webs of print media that have been marked by a continuous-forms printer (e.g., an upstream printer, not shown).

According to FIG. 3, dryer unit 300 comprises an enclosure 310 that includes an interior 312. Enclosure 310 also has an opening 318 for a web of print media to travel through. Enclosure 310 may comprise a solid material such as a metal or a plastic in combination with an insulating material, and will typically be chosen for its fire-resistant (or fireproof) properties, spectral or thermal reflectance, structural strength, etc. For example, the interior of enclosure 310 may comprise silver-plated aluminum.

An array of heating elements 314 are located within enclosure 310. Heating elements 314 heat web of print media 320 as it transits interior 312 (e.g., along an open path within interior 312). Each heating element 314 may comprise a radiant heater (e.g., heat lamp), an inlet for hot gas to enter interior 312, an electro-resistive heater, or various other components. Heat and/or mass flow from heating elements 314 is represented via element 316.

Web 320 may comprise any suitable material capable of receiving marking material and being dried by dryer unit 300. For example, web 320 may comprise a web of paper. In one embodiment, web 320 is oriented so that a wet, inked side of web 320 does not directly contact rollers 330 or 340 during the drying process.

Figure 4:
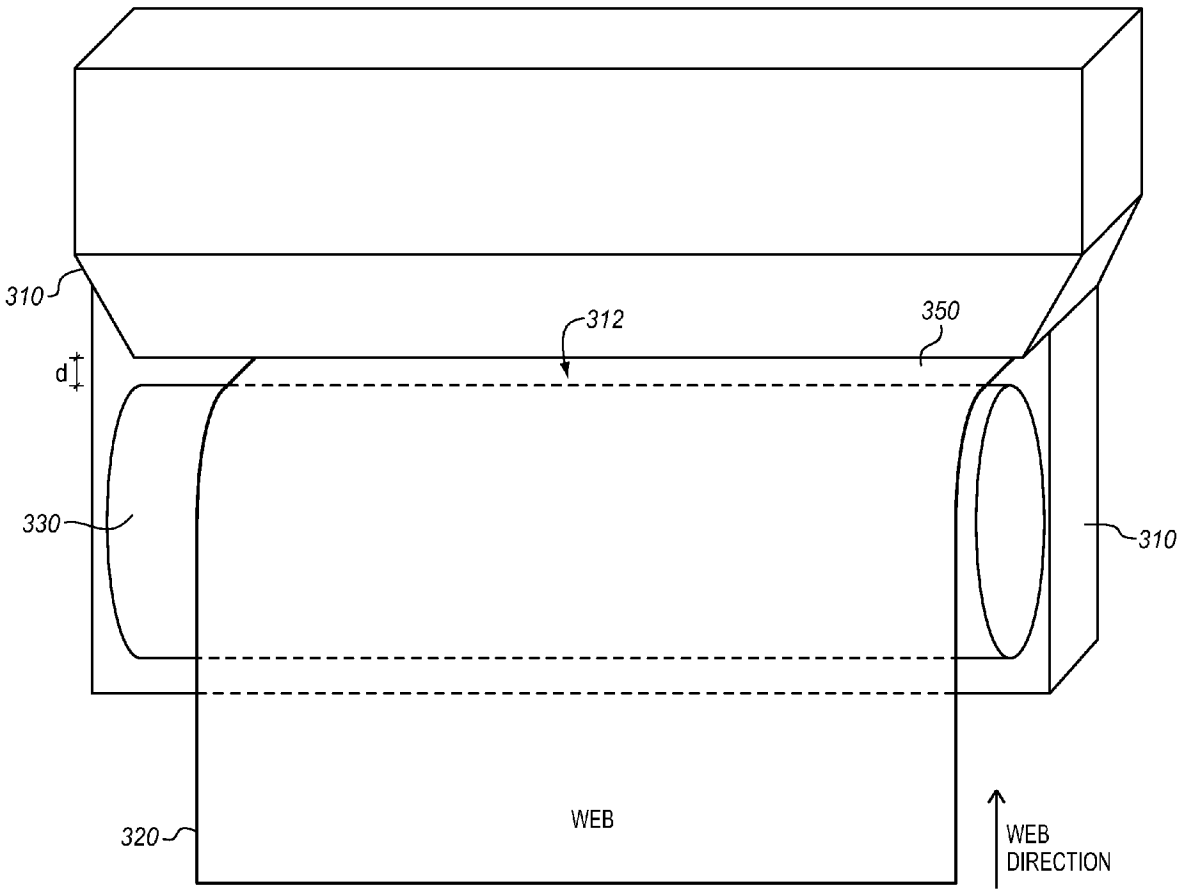
FIG. 4 is a block diagram illustrating a front view of a dryer unit in an exemplary embodiment.

Rollers 330 and 340 position web 320 as web 320 travels across interior 312. For example, rollers 330 and 340 may comprise cylindrical devices that are freely rotatable or fixed. Rollers 330 and 340 may further apply tension to web 320, and may further be driven by an outside force (e.g., a motor) to move web 320 through dryer unit 300. FIG. 4 further illustrates roller 330 as it positions web 320 for travel within enclosure 310.

The size of each opening defined by enclosure 310 alone (e.g., opening 318) is fairly large. Specifically, these openings are large enough to allow a substantial amount of oxygen to enter interior 312. This amount of mass transfer would allow a flame to escape interior 312 through one of the openings and enter the print shop.

To address this issue, rollers 330 and 340 each have perimeters that cover/block/obstruct/obscure a portion of an opening in enclosure 310. For example, roller 330, in combination with enclosure 310, forms a gap (entrance 350) for web 320 to travel through. Entrance 350 has a size that is defined on one side by the perimeter of roller 330, and that is defined on another side by a surface of enclosure 310 that forms a border of opening 318. Entrance 350 is sufficiently small in size (d) that it prevents a fire from traveling outside of enclosure 310 via entrance 350. Specifically, entrance 350 does not allow sufficient mass transfer of oxygen to enable anything more than minimal (i.e., substantially zero) fire escape. Roller 340, in combination with enclosure 310, forms a similarly-sized exit 360. FIG. 4 further illustrates the dimensions of entrance 350.

Because entrance 350 and exit 360 have a small enough size (d), the linear flow of oxygen to the dryer is small enough to prevent the fire from escaping along any single opening. Thus, the gaps for entrance 350 and exit 360 form fire enclosure openings that enhance the safety of dryer unit 300. At the same time, entrance 350 and exit 360 are located directly next to the rollers, where deflection of web 120 is minimal (because web 120 is more or less fixed to a roller at these locations). This means that web 120 resists deflection upward to contact dryer unit 300 and smear wet marking material.

Fire enclosure openings are dimensioned to prevent fire from escaping enclosure 310. For this reason, even though multiple fire enclosure openings, in combination, may provide enough oxygen for a fire inside enclosure 310 to continue, the fire cannot substantially escape through any one of those openings. The fire escape is minimal and the ability of the fire to transfer to components outside of the enclosure is substantially zero. Fire enclosure openings are described in further detail, for example, in the Standard for Safety of Information Technology Equipment IEC/UL 60950-1 application guideline, issued by Underwriters Laboratories Inc.® and herein incorporated by reference. For example, such standards may restrict the height of the fire enclosure opening to less than 1 millimeter (mm), yet allow for any length. In one embodiment, the height of the fire enclosure opening depends on the thickness of web 320, so that the fire enclosure opening is taller when thicker webs are used. For example, the fire enclosure opening may be 1.5 mm tall, where web 320 may have a thickness of up to 0.25 mm. Potentially, the fire enclosure opening could even be taller (e.g., even 12 mm tall).

FIG. 4 is a block diagram illustrating a front view of dryer unit 300 in an exemplary embodiment. Roller 330 positions web 320 as web 320 proceeds in its direction of travel and enters enclosure 310. The size (d) of entrance 350 is very small (e.g., mere millimeters), which prevents fires inside of dryer unit 300 from escaping.

In a further embodiment, a dryer unit may utilize an exhaust port such as a vent that allows particulate, smoke, and dust to leave the interior of the dryer unit. The exhaust port may be passive, or may include a fan (or other device) in order to create a negative pressure that draws fire and smoke upward and out of the dryer unit via the exhaust port instead of an entrance or exit of the dryer unit.

In a further embodiment, rollers used for the dryer unit may be positioned to avoid direct heating from a heating element of the dryer unit, and/or may include heat reflective surfaces to prevent the rollers from overheating.

In a further embodiment, the rollers or enclosure may be adjustably positioned to alter the size of an entrance or exit. This may be desirable if some webs are thicker than others. For example, the rollers may be adjustably positioned such that if the rollers expand due to heating from the dryer (and thereby shrink the size of their corresponding entrance or exit), the rollers may be repositioned to account for this change.

Figure 5:
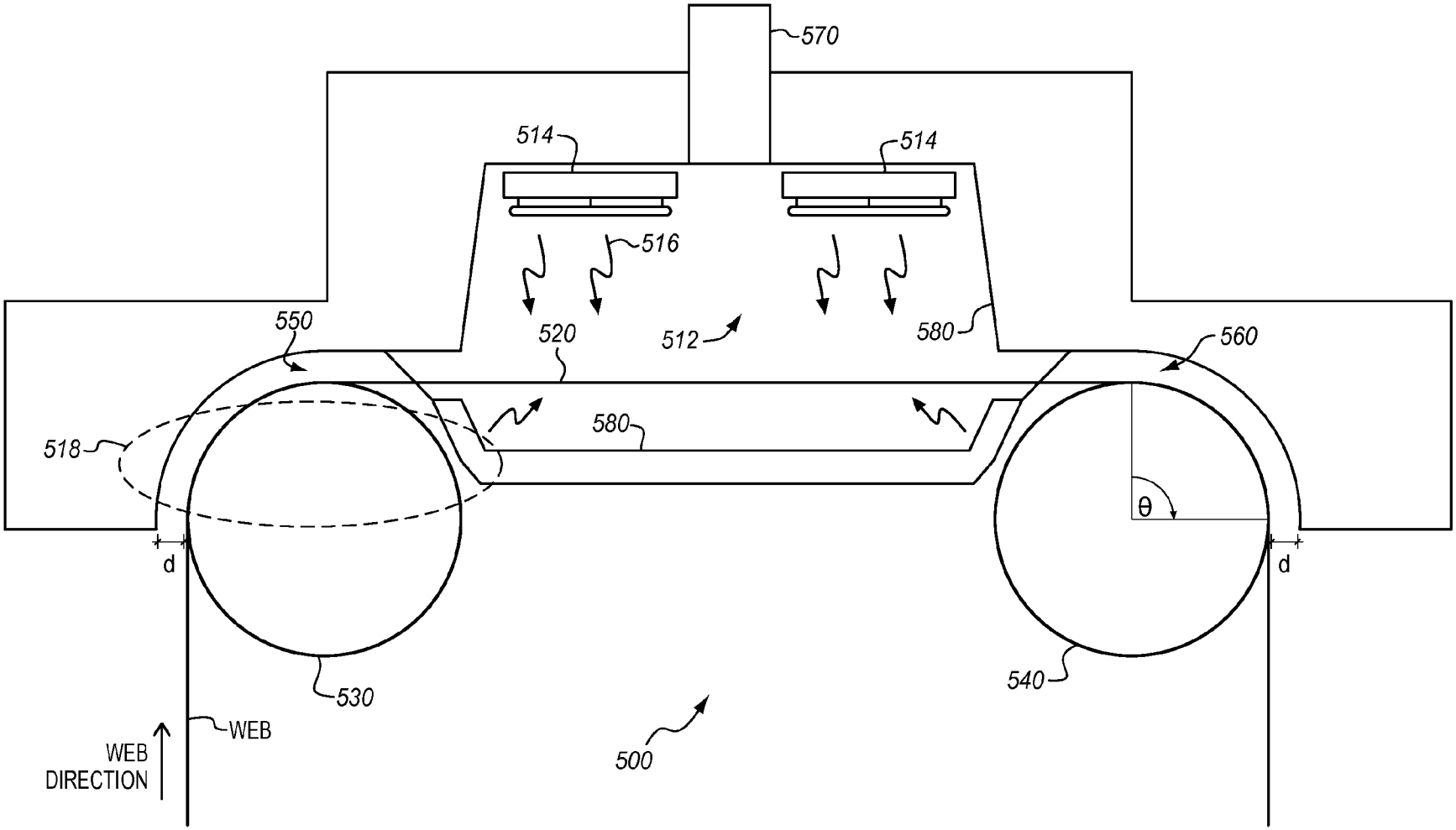
FIG. 5 is a block diagram illustrating a dryer unit implementing additional features in an exemplary embodiment.

FIG. 5 is a block diagram illustrating a dryer unit 500 implementing additional features in an exemplary embodiment. According to FIG. 5, enclosure 580 of dryer unit 500 includes an opening 518 which is partially covered by roller 530. Because of the unique shape of opening 518, web 520 enters a gap entrance 550 that is formed in the shape of an arc. The arc has a depth that extrudes into the page. This curving gap entrance 550 is defined by a curving surface of enclosure 580 on one side, and by a curved portion of the perimeter of roller 530 on the other side (the curved portion having an angle θ). Similarly, gap exit 560 is formed by enclosure 580 and roller 540. These arcing gaps may have a thickness (e.g., 1 mm) that keeps them compliant with standards for fire enclosure openings.

In FIG. 5, the surface of dryer unit 500 includes reflective elements, which reflect heat from interior 512 back onto web 520 and away from rollers 530 and 540. Rollers 530 and 540 have been positioned so that they are not directly heated by heating elements 514. Furthermore, the reflective elements of interior 512 have been positioned so that reflected heat strikes web 520, and not roller 530 or 540.

In this embodiment, dryer unit 500 further includes an exhaust port 570, which channels excess heat and exhaust out of dryer 500. This serves to create a pressure gradient at the gaps that draws air from outside into the dryer, which reduces the chance of a fire leaving the interior via any gap.

Although specific embodiments were described herein, the scope of the invention is not limited to those specific embodiments. The scope of the invention is defined by the following claims and any equivalents thereof.

We claim:

1. A dryer comprising:

an enclosure that includes an opening for a web of print media to travel between an exterior of the enclosure and an interior of the enclosure;

a heating element that is operable supply heat to the interior; and a roller proximate to the opening that aligns the web as the web travels within the interior, wherein a perimeter of the roller covers a portion of the opening, and wherein an uncovered portion of the opening comprises a gap for the web, the gap having a size defined on one side by the perimeter of the roller and on another side by a surface of the opening.

2. The dryer of claim 1 wherein:

the gap comprises a fire enclosure opening less than 12 millimeters tall.

3. The dryer of claim 1 wherein:

the gap comprises an extruded arc that is formed on one side by a curving surface of the enclosure and on another side by a curved portion of the perimeter of the roller.

4. The dryer of claim 1 wherein:

the enclosure further includes an exhaust port that is operable to remove air from the interior to create a pressure gradient at the gap that draws air from outside of the gap towards the interior to reduce the chance of a fire leaving the interior via the gap.

5. The dryer of claim 1 wherein:

the roller includes a surface that is substantially heat reflective.

6. The dryer of claim 1 wherein:

the interior further comprises heat reflective elements that are positioned to prevent direct radiation of heat from the heating element onto the roller.

7. The dryer of claim 1 wherein:

the roller is adjustably positioned in order to enable alterations to the size of the gap.

8. The dryer of claim 1 wherein:

the size of the gap is in compliance with the Standard for Safety of Information Technology Equipment IEC/UL 60950-1 application guideline.

9. A dryer comprising:

an enclosure;

a roller proximate to an opening into the enclosure, wherein a perimeter of the roller covers a portion of the opening, and wherein an uncovered portion of the opening comprises a gap for a web of print media, the gap having a size defined on one side by the perimeter of the roller.

10. The dryer of claim 9 wherein:

the gap comprises a fire enclosure opening less than 12 millimeter tall.

11. The dryer of claim 9 wherein:

the gap comprises an extruded arc that is formed on one side by a curving surface of the enclosure and on another side by a curved portion of the perimeter of the roller.

12. A system comprising:

a continuous-forms printer; and a printing system dryer operable to dry a web of print media that has been marked by the printer, the dryer comprising:

an enclosure;

a heating element located within an interior of the enclosure that is operable to generate heat within the enclosure;

a first roller located proximate to the enclosure that obscures a portion of an opening into the enclosure and positions the web of print media as the web enters the enclosure, where the unobscured portion of the opening is sufficiently small to prevent fires inside of the enclosure from leaving the enclosure via the entrance; and a second roller located proximate to the enclosure that obscures a portion of another opening into the enclosure and positions the web as the web exits the enclosure, where the unobscured portion of the other opening is sufficiently small to prevent fires inside of the enclosure from leaving the enclosure via the exit.

13. The system of claim 12 wherein:

the unobscured portion of the opening is bounded by a perimeter of the first roller and by a surface of the enclosure.

14. The system of claim 12 wherein:

the unobscured portion of the opening comprises an extruded arc that is formed on one side by a curving surface of the enclosure and on another side by a curved portion of the perimeter of the roller.

15. The system of claim 12 wherein:

the enclosure further comprises an exhaust port that is operable to remove air from the interior of the enclosure, thereby creating a pressure gradient at the openings that draws air from outside towards the interior of the enclosure.

16. The system of claim 12 wherein:

the first roller comprises a surface that is substantially heat reflective.

17. The system of claim 12 wherein:

the interior further comprises heat reflective elements that are positioned to prevent direct radiation of heat from the heating element onto the first roller.

18. The system of claim 12 wherein:

the heating element comprises a radiant heat lamp.

19. The system of claim 12 wherein:

the first roller is adjustably positioned in order to enable alterations to the size of the unobscured portion of the entrance.

20. The system of claim 19 wherein:

the first roller is further adjustably positioned to allow an increase in the size of the unobscured portion of the entrance in order to compensate for thermal expansion of the roller.

* * * * *